United States Patent [19]

Kawakatsu et al.

[11] Patent Number: 4,652,789

[45] Date of Patent: Mar. 24, 1987

[54] INCANDESCENT LAMP WITH BULB HAVING IR REFLECTING FILM

[75] Inventors: Akira Kawakatsu, Yokohama; Tsutomu Watanabe, Yokosuka; Yoji Yuge, Chigasaki, all of Japan

[73] Assignee: Kabushiki Kaisha Toshiba, Kawasaki, Japan

[21] Appl. No.: 740,881

[22] Filed: Jun. 3, 1985

[30] Foreign Application Priority Data

Jun. 5, 1984 [JP] Japan ..... 59-113934

[51] Int. Cl.[4] ..... H01K 1/26

[52] U.S. Cl. ..... 313/112; 313/315

[58] Field of Search ..... 313/112, 315

[56] References Cited

U.S. PATENT DOCUMENTS 2,552,184 5/1951 Koch .

4,017,758 4/1977 Almer et al. ..... 313/112

4,409,512 10/1983 Walsh ..... 313/113

FOREIGN PATENT DOCUMENTS 58-65403 4/1983 Japan .

*Primary Examiner*—Palmer C. DeMeo

*Attorney, Agent, or Firm*—Schwartz, Jeffery, Schwaab, Mack, Blumenthal & Evans

[57] ABSTRACT

This invention relates to an incandescent lamp bulb comprising a visible light transmitting and infrared ray reflecting film formed on at least either one of the inside and outside of a tubular, transparent bulb, said film being composed of a lamination of alternate high and low refractive index layers, wherein the optical film thickness of any one of the high reflective index layers ranges from 0.21 to 0.31$\mu$, that of the topmost low refractive index layer ranges from $\frac{1}{2}\times0.21$ to $\frac{1}{2}\times0.31\mu$, that of at least one low refractive index layer ranges from $2\times0.21$ to $2\times0.31\mu$, and that of any remainder low refractive index layer ranges from 0.21 to 0.31$\mu$.

4 Claims, 4 Drawing Figures

INCANDESCENT LAMP WITH BULB HAVING IR REFLECTING FILM

BACKGROUND OF THE INVENTION

1. Technical Field of the Invention

This invention relates to the formation of structures of incandescent lamp bulbs whose efficiencies have been enhanced.

2. Technical Background

The present inventors et al proposed an incandescent lamp bulb of tubular, transparent shape comprising a visible ray transmitting and infrared ray reflecting film formed on at least one surface of the inside and outside of the bulb, said film being composed of a lamination of alternate high and low refractive index layers consisting respectively of such as titanium dioxide $TiO_2$ and silica $SiO_2$, and a tungsten filament centrally and longitudinally disposed in said bulb.

Only visible radiation of the light emitted from the filament of the incandescent lamp bulb passes through the infrared ray reflecting film for emission to the external, while the infrared radiation is reflected by the infrared ray reflecting film to be fed back to the filament to cause it to further heat, thereby improving markedly the incandescent lamp efficiency.

Such a conventional infrared ray reflecting film constitutes substantially a $\frac{1}{4}$-wavelength ($\lambda$) interference filter so designed as to make the maximum reflection wavelength $\lambda$ coincide with the peak wavelength (in the approximately of $1\mu$) in the infrared radiation energy distribution of the filament.

Consequently, the lamp efficiency was by no means favorable, because whereas the reflectance for near infrared radiation was fairly good, the visible light transmittance was not taken into account.

SUMMARY OF THE INVENTION

1. Object of the Invention

It is an object of this invention to provide an incandescent lamp bulb of further improved lamp efficiency by enhancing as much as possible both the infrared ray reflectance and the visible light transmittance of a visible ray transmitting and infrared ray reflecting film formed on either one (or both) of the outside and inside of the lamp bulb.

2. Subject Matter of the Invention

The subject matter of the present invention resides in that both the infrared ray reflectance and the visible ray transmittance have been improved by forming a plurality of high refractive index layers, each ranging in optical film thickness from 0.21 to $0.31\mu$ and a plurality of low refractive index layers, the topmost layer of which ranges in optical film thickness from $\frac{1}{2}\times0.21$ to $\frac{1}{2}\times0.31\mu$, i.e 0.105 to $0.150\mu$, at least one of which ranges from $2\times0.21$ to $2\times0.31\mu$, i.e. 0.42 to $0.62\mu$, and any one of the remainder ranges from 0.21 to $0.31\mu$.

DETAILED DESCRIPTION OF THE INVENTION

Preferred Embodiment

Figure 1:
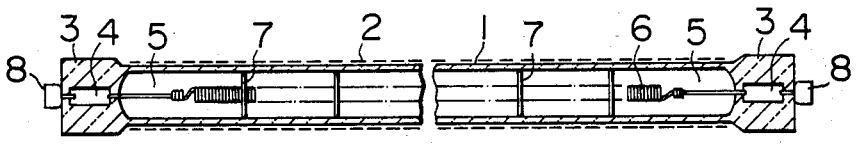
FIG. 1 is a simple illustration showing the longitudinal cross-sectional view for an embodiment of the incandescent lamp bulb constructed in accordance with the present invention.

Referring now in detail to FIG. 1 which illustrates a preferred embodiment of a "halogen" lamp bulb according to this invention, (1) is a straight, transparent quartz-glass bulb and (2) is a visible ray transmitting and infrared ray reflecting film formed on the outside surface of the bulb (1).

(3) and (3) each show a bulb-end pinched and sealed part of the bulb (1), (4) and (4) each show a molybdenum lead foil imbedded in the sealed part (3), and (5) and (5) each show an inner lead introduced in the bulb (1).

(6) denotes a coiled filament made of tungsten wire which spans said inner leads (5) and (5) and disposed centrally along the center axis of the bulb (1), (7) and (7) each denote an anchor for supporting the filament (6), and (8) and (8) each denote a terminal installed at the end of the sealed part (3), which is connected to the lead foil (4). The tubular bulb is filled with an inert gas such as argon gas, together with the required amount of a halogen material.

Figure 2:
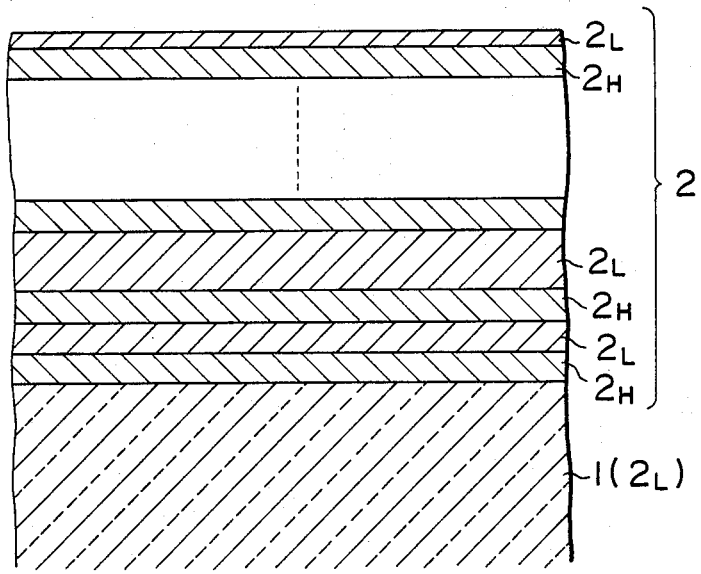
FIG. 2 is a sketch showing a schematic, magnified view of the essential part, or the multilayer film, according to the embodiment illustrated in FIG. 1.

As schematically illustrated in FIG. 2, the aforementioned visible-ray transmitting and infrared-ray reflecting film is composed of a plurality of laminated layers in which two different kinds of layers are disposed alternately: One is a high refractive index layer (2H) consisting such as of titanium dioxide ($TiO_2$), tantalum oxide ($Ta_2O_5$), zirconium oxide ($ZrO_2$), or zinc sulfide ($ZnS$) and the other is a low refractive index layer (2L) consisting of such as silica ($SiO_2$) or magnesium fluoride ($MgF_2$).

The optical film thickness of each high refractive index layer (2H) ranges from 0.21 to 0.31 micron ($\mu$).

The optical film thickness of the topmost low refractive index layer (2L) ranges from $\frac{1}{2}\times0.21$ to $\frac{1}{2}\times0.31$ micron ($\mu$), i.e. from 0.105 to $0.150\mu$, that of at least one of the remainder layers ranges from $2\times0.21$ to $2\times0.31\mu$, i.e. from 0.42 to $0.62\mu$, and any one of the remainder ranges from 0.21 to $0.31\mu$ in the optical film thickness. Incidentally, by the term "optical film thickness" is meant the value of actual film thickness multiplied by the refractive index.

To form such an infrared ray reflecting film (2), it is necessary at first to exhaust air contained in the bulb after the filament (6) and other sealed parts have been installed and a required amount of a halogen material has been sealed therein together with an inert gas.

It is besides necessary to prepare two kinds of solutions as follows:

One is a titanium compound solution so controlled as to contain titanium content of from 2 to 10 weight percent and have a viscosity of about 2.0 cps by dissolving an organic titanium compound such as tetraisopropyl titanate in an organic solvent, and the other is a silicon compound solution so controlled as to contain silicon content of from 2 to 10 weight percent and have a viscosity of about 1.0 cps by dissolving an organic silicon compound such as ethyl silicate in an organic solvent.

The aforementioned sealed bulb will be dipped in the first place into the titanium compound solution in a constant-temperature and constant-humidity atmosphere and raised at a predetermined speed, followed by a drying process in the air and a sintering process at about 600° C. for 5 minutes, for the formation of a high refractive index layer (2H).

Then, the sealed bulb coated with the high refractive index layer (2H) will be again dipped into a silicon compound solution in a constant-temperature and constant-humidity atmosphere and raised at a predetermined speed, followed by a drying process in the air and a sintering process at about 600° C. for 5 minutes for the formation of a subsequent low refractive index layer (2L) on the aforementioned high refractive index layer (2H).

Such as this, the high refractive index layer (2H) and the low refractive index layer (2L) are formed alternately and in succession until a predetermined number of laminated layers are formed. The optical film thicknesses of these layers, 2H and 2L, can be suitably controlled by adjusting the viscosities or the metal concentrations of the aforementioned two solutions.

Now a description will be made of the operation of this incandescent lamp bulb.

When a suitable voltage is applied across both terminals (8) and (8) to cause the lamp to light, the filament is heated to incandescence by an electric current conducted through the filament, emitting visible radiation and, at the same time, a great deal of infrared radiation.

Of the radiation emitted from the filament, visible light ranging in wavelength passes through the infrared ray reflecting film (2) for emission to the external, environment while the infrared radiation is reflected from the film (2), and is fed back to the filament to reinforce incandescence. As a result, the amount of visible radiation increases markedly for the magnitude of the actual electric current flowing through the filament—i.e., the lamp efficiency is greatly improved.

With such a lamp bulb construction, it is a matter of course, in view of maintaining high lamp efficiencies, that the visible ray transmittance of the film (2) should be made as high as possible and that the reflectance of infrared radiation, notably of near infrared rays, should be also made as high as possible.

The visible light transmittance and the infrared ray reflectance of the same infrared ray reflecting film (2) can scarcely be compatible with each other— that is, the improvement of one will invariable result in the degradation of the other.

According to the principle of this invention, as has been previously described, the optical film thickness of each high refractive index layer (2H) has been set to the range 0.21 to 0.31μ, or the wavelength range of near infrared rays.

Furthermore, the standard or keynote optical film thickness of each low refractive index layer (2L) has been set to the same range, or from 0.21 to 0.31μ, except that the thickness of some layer(s) has been set to twice the standard thickness range, or 0.42 to 0.62μ, and the thickness of the topmost layer has been set to one-half the standard thickness range, or 0.105 to 0.150μ.

As a consequence, both the infrared ray reflectivity, notably the near infrared ray reflectance and the visible ray transmittance have been remarkably improved, contributing greatly to improvements in the lamp bulb efficiency.

Table 1 shows some concrete structural embodiments of the infrared ray reflecting film (2) according to this invention as compared with conventional structural examples.

TABLE 1

| | | Conventional Example | | Embodiment of the Invention | | | |
|---|---|---|---|---|---|---|---|
| Layer No. | Layer Kind | I 8 Layers | II 12 Layers | I 8 Layers | II 12 Layers | III 16 Layers | IV 20 Layers |
| 1 | 2H | d | d | d | d | d | d |
| 2 | 2L | d | d | 2d | 2d | 2d | 2d |
| 4 | 2L | d | d | d | 2d | 2d | 2d |
| 6 | 2L | d | d | d | d | 2d | 2d |
| 8 | 2L | ½d | d | ½d | d | d | 2d |
| 10 | 2L | | d | | d | d | d |
| 12 | 2L | | ½d | | ½d | d | d |
| 14 | 2L | | | | | d | d |
| 16 | 2L | | | | | ½d | d |
| 18 | 2L | | | | | | d |
| 20 | 2L | | | | | | ½d |

NOTES:
[1]Layer No. will be counted from the bottom, or the closest layer to the bulb surface
[2]Although specifications for the odd-numbered layers (all to be 2H) corresponding to the 3rd or higher order layers have been omitted in Table 1 for brevity, but their optical film thickness range will be all d, or standard thickness range
[3]The standard dimensional unit for all optical layer thicknesses will be d, or an optional value ranging between 0.21 and 0.31μ.

Figure 3:
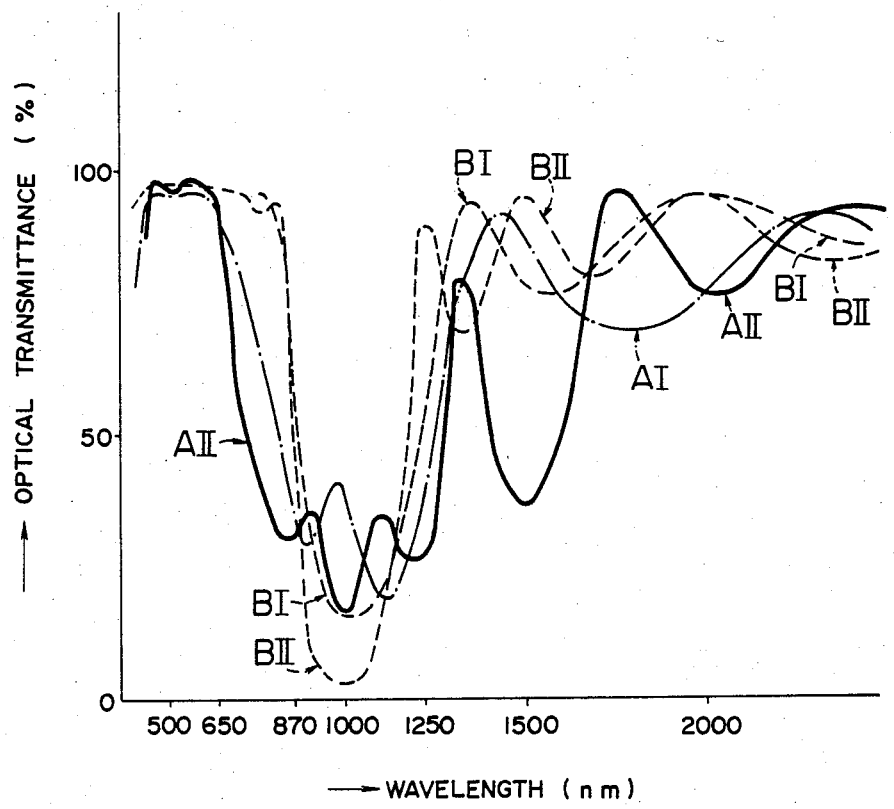
FIGS. 3 and 4 each illustrate a frequency spectrum for the optical characteristics of the infrared ray reflecting films according to the conventional examples and the preferred embodiments of this invention.
Figure 4:
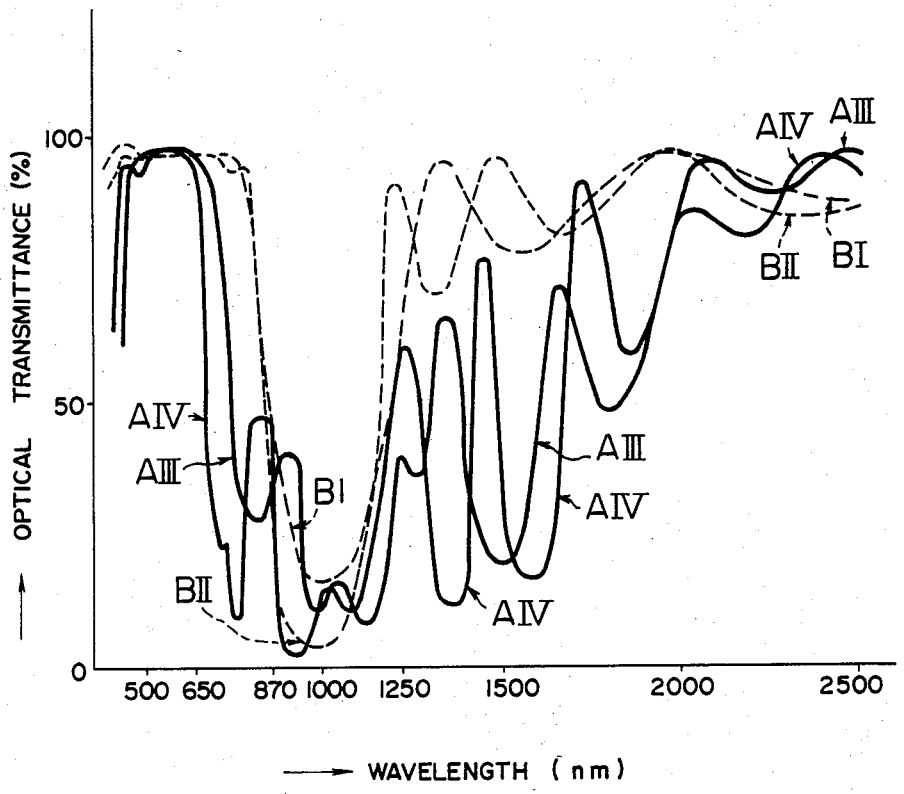

FIGS. 3 and 4 each show graphs depicting the optical characteristics of the multilayer films according to the conventional examples and the embodiments improved by this invention.

In both figures, the wavelength (nm) and the optical transmittance (%) are taken as the abscissa and the ordinate, respectively.

In FIG. 3, the curves, AI and AII, show the spectral transmittance of the multilayer films according to embodiments, I and II, of this invention respectively, while the curves, BI and BII, show those for the conventional examples, I and II, respectively.

Similarly, in FIG. 4, the curves, AIII and AIV, show respectively the spectral transmittance for the embodiments, III and IV, according to this invention, while the curves, BI and BII, show respectively those for the previous, conventional examples.

Table 2 shows our investigation results for a comparison of the optical and lamp characteristics of "halogen" lamp bulbs rated at 100 V and 500 W having the construction as shown in FIG. 1, which employ the infrared ray reflecting films (2) according to the conventional examples and the embodiments improved by this invention.

TABLE 2

| | Conventional Example | | Embodiment of the Invention | | | |
|---|---|---|---|---|---|---|
| Reflecting Film | BI | BII | AI | AII | AIII | AIV |
| Visible Light Transmittance (%) | 93.8 | 94.4 | 93.9 | 94.3 | 94.9 | 92.7 |
| Max. Reflectance for Infrared Ray (%) | 85 | 88 | 84 | 83 | 90 | 97 |
| Max, Reflectance Peak Wavelength (nm) | 1000 | 1000 | 1120 | 970 | 1100 | 920 |
| Lamp Efficiency (Relative Value) (%) | 100 | 116 | 118 | 182 | 255 | 332 |

NOTES:
[1]The term "visible light transmittance" means the transmittance of visible light (380–780 nm) corrected by luminous efficiency.
[2]The term "infrared ray" means spectral radiation in the spectrum ranging from 800 to about 2500 nm.
[3]By "lamp efficiency" is meant a relative value for a conventional "clear" lamp taken as 100% lamp efficiency.

As will be obvious from Table 2, any one of the infrared ray reflecting films formed on the bulbs according to the embodiments of this invention is superior both in the visible ray transmittance and in the infrared ray reflectance to any one of the conventional examples. In addition, the peak value of the reflectance is within the near infrared ray range. These features have greatly contributed to enhancement of the lamp efficiency.

According to the foregoing embodiments of this invention, the low refractive index layer of twice the standard optical thickness is disposed as the innermost or a relatively inner low refractive index layer.

The standard dimensional unit d taken for the thicknesses of the layers, 2H and 2L, in the infrared ray reflecting films (2) according to this invention may be varied more or less among these layers, insofar as its varying range remains between 0.21 and 0.31μ.

Further, there should be no objection for forming the infrared ray reflecting film (2) on the inside of the bulb, insofar as at least either side of the bulb is coated with the multilayer film (2). Still further, the effect of the present invention remains unchanged, even if a low refractive index layer of an optional thickness is interposed between the No. 1 high refractive index layer and the bulb surface.

It has also been verified that the bulb may be of T shape, or may be of any geometrical shape, provided infrared rays reflected from these infrared ray reflecting layers can be fed back to the filament.

It will also be understood that the present invention can be applied to the ordinary lamp bulbs.

With bulb construction, as mentioned above both the visible ray transmittance and the infrared ray reflectance of the infrared ray reflecting film have been improved and a "peak" of the spectral energy distribution of the reflected light has shifted toward the near infrared region, resulting in marked improvements in the lamp efficiency.

What is claimed is:

1. An incadescent lamp, comprising:

a transparent bulb having a longitudinal axis;

a filament centrally disposed along said longitudinal axis; and a visible light transmitting and infrared ray reflecting film comprising a plurality of alternating high and low refractive index layers positioned on at least one of the inside and outside of said bulb;

wherein the optical film thickness of each of said high refractive index layers ranges from about 0.21 to about 0.31μ; and wherein the optical film thickness of the low refractive index layer outermost from said filament ranges from about 0.105 to about 0.155μ, and wherein at least an innermost low refractive index layer has an optical film thickness of from about 0.42 to about 0.62μ.

2. An incandescent lamp according to claim 1, wherein at least one low refractive index layer in addition to said innermost layer has an optical film thickness ranging from about 0.42 to about 0.62μ, and is disposed nearer to said innermost layer than to said outermost layer, and wherein any remaining low refractive index layers have an optical film thickness of from about 0.21 to about 0.31μ.

3. An incandescent lamp according to claim 1, wherein said bulb is tubular, and wherein the number of said high and low refractive index layers is from about 8 to about 20.

4. An incandescnet lamp, comprising:

a transparent bulb having a longitudinal axis;

a filament made of tungsten wire centrally disposed along said longitudinal axis; and a plurality of alternating high and low refractive index layers positioned on at least one of the inside and outside of said bulb;

wherein the optical film thickness of each of said high refractive index layers ranges from about 0.21 to about 0.31μ; and wherein the optical film thickness of the low refractive index layer outermost from said filament ranges from about 0.105 to about 0.155μ and wherein at least one low refractive index layer other than said outermost layer has an optical film thickness of from about 0.42 to about 0.62μ.

* * * * *